United States Patent [19]

Burns

[11] Patent Number: 4,597,621

[45] Date of Patent: Jul. 1, 1986

[54] RESETTABLE EMERGENCY RELEASE MECHANISM

[75] Inventor: Edgar Burns, Los Angeles, Calif.

[73] Assignee: Automation Industries, Inc., Greenwich, Conn.

[21] Appl. No.: 699,798

[22] Filed: Feb. 8, 1985

[51] Int. Cl.[4] ..... H01R 13/633

[52] U.S. Cl. ..... 339/90 R; 339/89 M; 339/DIG. 2

[58] Field of Search ..... 339/89 R, 89 C, 89 M, 339/90 R, 90 C, DIG. 2, 45 R, 45 M; 285/2

[56] References Cited

U.S. PATENT DOCUMENTS 3,801,954 4/1974 Dorrell ..... 339/113 R 4,389,081 6/1983 Gallusser et al. ..... 339/89 R 4,531,801 7/1985 Baur ..... 339/89 M

*Primary Examiner*—John McQuade

*Attorney, Agent, or Firm*—George J. Netter

[57] ABSTRACT

A spring mechanism is positioned to hold two members of, e.g., an electrical connector which are moveable relative to each other, securely together and to resist motion of the one element with respect to the other in a decoupling direction until the force exerted on the spring exceeds a predetermined force. At this point, the spring, due to its structure, pops or flips to another position producing a decrease in the overall spring diameter causing the spring to clear retaining grooves in one or both of the two members such that the two members are released.

13 Claims, 10 Drawing Figures

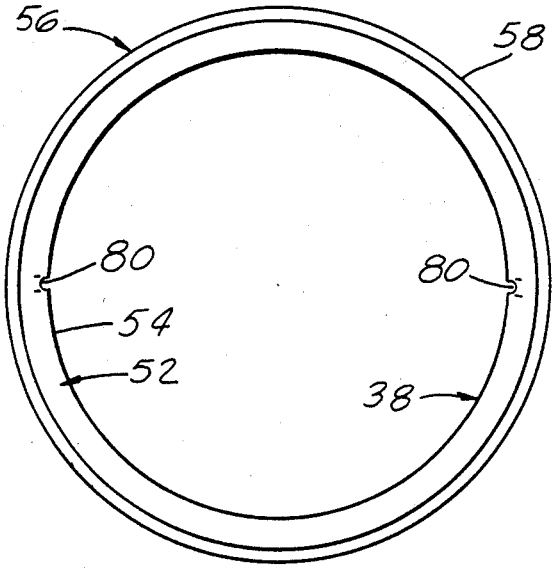
FIG. 5.
FIG. 6.
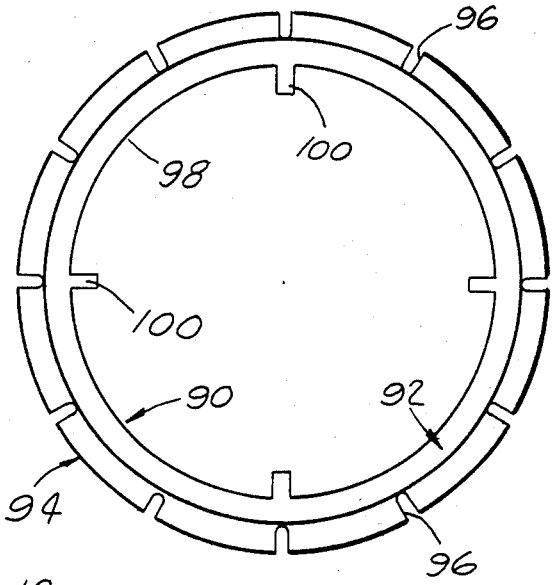
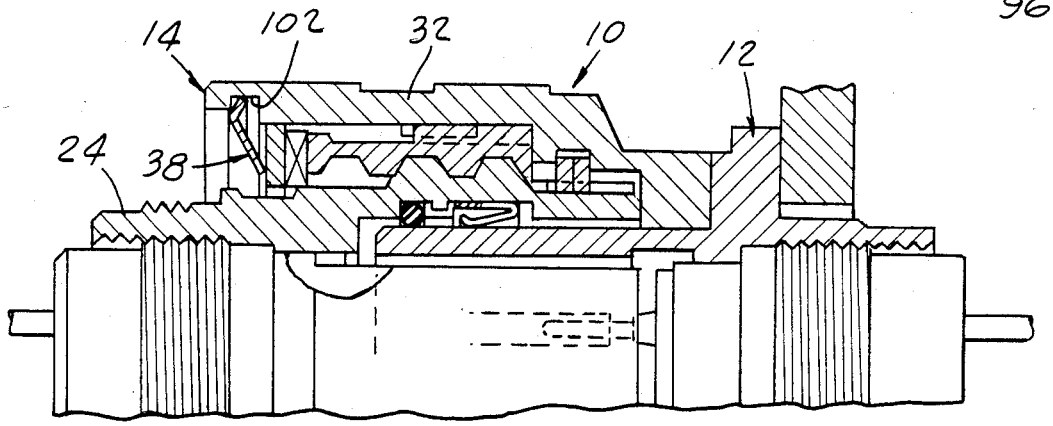
FIG. 7
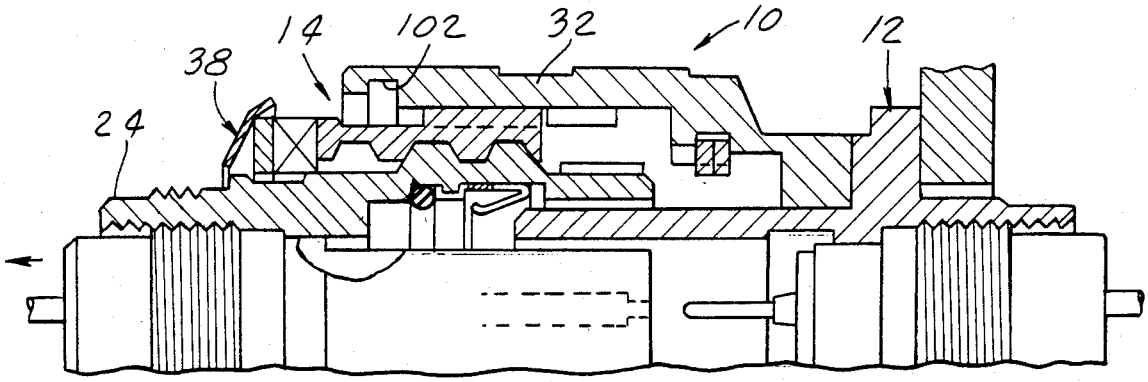
FIG. 8

RESETTABLE EMERGENCY RELEASE MECHANISM

FIELD OF INVENTION

The present invention relates to resettable emergency release mechanisms which are particularly adapted for use in electrical connectors for the purpose of holding the members of the connector together in normal operating conditions but allowing for relative movement of those connector members when a force exceeding some selected force is exerted in an unmating direction of the connector. This assures disconnection of the plug and receptacle elements of the connector.

BACKGROUND AND SUMMARY OF THE INVENTION

Oftentimes with electrical connectors, particularly those of the linear variety in which the plug and receptacle of the connector are demated without the need for rotation of the plug with respect to the receptacle, there is need for emergency release to decouple the connector when some force exceeding a selected force is exerted axially upon the plug or receptacle portion of the connector. For example, if a locking ring should jam and emergency disconnection is necessary, an immediate releasing means may be necessary to effect disconnection.

Another example might be in an umbilical connector or a connector to a detachable aircraft service module, e.g., a weapons pod designed to separate from the aircraft. These are typically disconnected by some mechanical means operated by the tugging force of separation upon a lanyard. Should this fail to effect disconnection of the connector, serious consequences could arise, e.g., a dangling service pod which could prevent landing of the aircraft or a severing of the umbilical cord in lieu of decoupling the connector.

It has been known in the past to try to alleviate this problem by providing for emergency release mechanisms which will allow a portion of the connector to come apart when an appropriately large force is exerted, indicating that normal decoupling did not occur. Thus, for example, the plug portion of the connector may have an inner member which is contained within a plug connector housing and which contains the actual plug or socket contacts of the connector, into which the corresponding socket or plug contacts of the receptacle member of the connector are inserted to accomplish the electrical connection by the connector. This inner portion has, in the past, been made releasable by providing a destructible emergency release mechanism, for example, a shearpin. The shearpin shears at an approximate force exerted in the decoupling procedure and is intended to allow the inner portion of the connector member to be removed from the connector housing upon the occurrence of a force, e.g., when a releasable pod is dropped from an aircraft wing and the pod weight is supported by the connector, if normal decoupling does not occur. Once the shearpin shears, the plug and receptacle connections of the connector are unmated, effecting disconnection of the connector.

Such destructible emergency release mechanisms suffer from several drawbacks, however. The first of these drawbacks is that the force exerted which will cause the shearpin to shear can vary with several factors, including a variation in the material from which the shearpin is constructed, manufacturing tolerances in the size of the shearpin, for example, in cross-sectional area, and several possible factors relating to the geometry of the connector and the manner in which the shear force is applied to the shearpin, for example, due to canting with respect to each other of the two members of the connector which are applying force to the shearpin. A second, and perhaps more serious drawback to the destructible type of emergency release mechanism is that the mechanism cannot be tested to determine the exact force at which the desired release will occur. A given destructible release mechanism may be tested, and a large number may also be tested to obtain data which may be helpful in estimating the effectiveness of the destructible release mechanism to release at the desired force or within the desired range of forces. However, for any given destructible release mechanism, the only effective test is one which results in the destruction of that particular destructible release mechanism.

Recognizing the shortcomings in the emergency release mechanisms previously utilized, e.g., for the protection of electrical connectors, it is the general object of the present invention to provide a non-destructible emergency release mechanism for electrical connectors, and other possible uses.

A feature of the present invention resides in the use of a spring mechanism which is positioned to hold two members of, e.g., an electrical connector which are moveable relative to each other in position within the connector and to resist motion of the one element with respect to the other in a decoupling direction until the force exerted on the spring exceeds a predetermined force. At this point, the spring, due to its structure, pops or flips to another position. This flipping or popping of the spring to the second position results in a decrease in the size of the outer perimeter of this spring. This decrease allows for the spring to clear retaining grooves in one or both of the two members such that the relative movement between the two members is no longer impeded.

Another feature of the present invention is the ability to adjust the force at which the release will occur or the range of forces within which the release will occur by modifying the shape of the spring, the thickness of the spring, or the material of the spring. Also, extension tabs may be provided as will be further described below.

It will be appreciated by those skilled in the art that the present invention provides a vast improvement over prior emergency release mechanisms of the destructible variety. The release mechanism of the present invention is easy to manufacture and to assemble into a completed connector. It is testable, in that it can be run through a number of cycles to determine whether the force at which the mechanical release occurs is within a desired range of forces such that the connector will not release inadvertently under normal operating or decoupling conditions, but will release at a force sufficiently low to insure disconnection. These and other features of the present invention will be better understood by reference to the detailed description of a preferred embodiment which follows:

BRIEF DESCRIPTION OF THE DRAWINGS

FIG. 4-A shows a cross-sectional view of the over-the-center spring of FIG. 3 in both relaxed positions;

FIG. 5 shows a plan view of an over-the-center spring employed in the present invention having pressure-applying notches;

FIG. 6 shows an alternative embodiment of an over-the-center spring according to the present invention having spring tabs;

FIG. 7 shows a cut-away partial cross-section as shown in FIG. 1, with the emergency release mechanism in the locked position, with the over-the-center spring in its first relaxed position and the flange engaging an annular locking groove;

FIG. 8 shows a cut-away partial cross-section as shown in FIGS. 1 and 7, after the over-the-center spring flips or pops to its second relaxed position and disconnection is effected because the flange clears the locking groove.

DETAILED DESCRIPTION OF PREFERRED EMBODIMENTS

Figure 1:
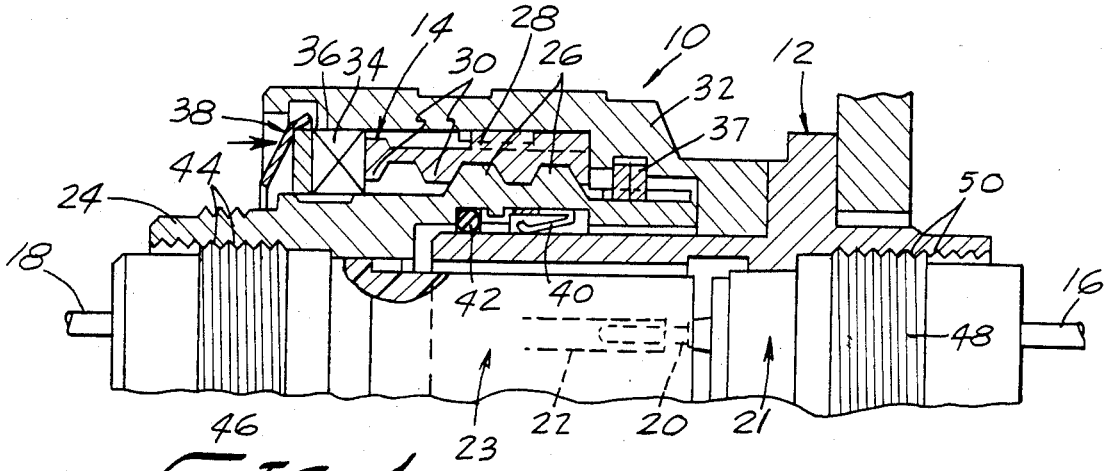
FIG. 1 shows a cut-away, partial cross-section of a connector having an emergency release mechanism, according to the present invention.

Turning now to FIG. 1, there is shown a partially cut-away cross-section of an electrical connector generally designated as 10 in which can be used an emergency release mechanism according to the present invention. The connector chosen to illustrate the operation of the emergency release of the present invention is a connector manufactured by the assignee of the present invention, an example of which is shown in the copending application of Bauer Ser. No. 577,974, now U.S. Pat. No. 4,531,801 also assigned to the assignee of the present invention, the disclosure of which is hereby incorporated by reference.

The connector 10 consists of a receptacle housing generally designated as 12 and a plug housing generally designated as 14. The receptacle housing 12 receives a plurality of electrical wires, one of which 16 is shown in FIG. 1. The plug housing 14 receives a like number of electrical wires, one of which 18 is shown in FIG. 1. The receptacle housing has a plurality of electrical contacts corresponding to the number of wires 16, one of which is shown as pin contact 20 in FIG. 1. The pin contact 20 is mounted in a receptacle insert 21 contained within the receptacle housing 12. The plug housing 14 has a plurality of socket contacts 22 corresponding to the number of wires 18, with the socket contacts 22 being contained within a plug insert 23 contained within a generally cylindrical plug shell 24, contained within the plug housing 14.

The receptacle 12 and plug 14 are fully mated and held in a mated position by a coupling ring 32. The plug shell 24 has a plurality of threads 26 on its outer surface which are engaged by threads 30 contained on a drive nut 28 which is fixed in relation to the coupling ring 32 by a wave spring 34 and wave spring cover 36. In the past, the wave spring cover has been held in place with respect to the coupling ring 32 by a locking ring which was not releasable, or was releasable by some destructive action, e.g., the shearing of a shearpin.

The shell of the plug 14 is engaged by an electromagnetic field absorption spring 40 when the plug insert 23 is inserted into the shell of the receptacle 12, with the surrounding portion of the plug 14 surrounding the shell of the receptacle 12.

The present invention employs a spring release, for example, spring release 38, explained in more detail below, which has the property of maintaining generally one shape as force is applied to the spring along a line generally parallel to the axis of revolution of the spring, i.e., the center-line axis of the spring, until a given force is reached which causes the spring to assume a second position, i.e., pop or flip over-the-center. The spring 38 is constructed with, for example, a protruding flange, as explained below, such that the radial space occupied by the spring 28 is smaller in the second position than in the first, such that in the first position the spring may be employed as a locking ring and in the second position the size of the spring 38 provides sufficient clearance such that the function of the spring 38 as a locking ring is no longer possible. In this manner, an emergency release is created which is sensitive to pressure applied along the mating-unmating axis of the connector.

Figure 2:
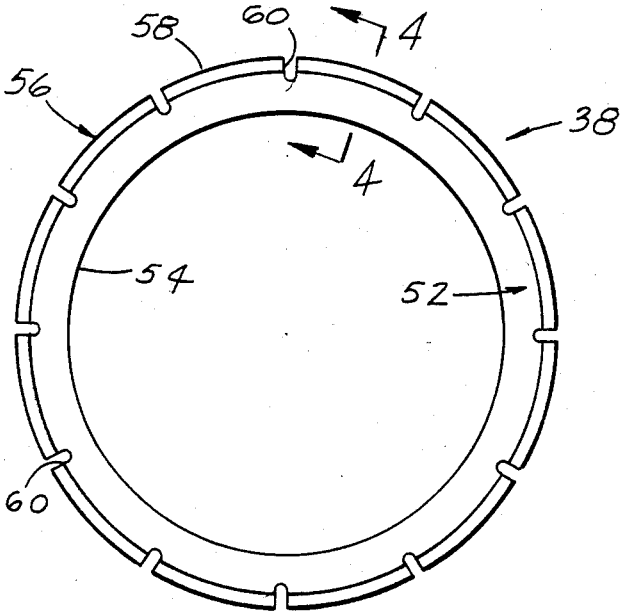
FIG. 2 shows a cut-away plan view of an over-the-center spring employed in the emergency release mechanism according to the present invention.

Such a spring means 38 is shown in further detail in FIG. 2 to be a circular flat stock conical spring having a conical section 52. The conical section 52 has the apex removed to form an opening and terminates in an engaging rim 54. The spring means 38 also has a flange section, generally designated as 56, which has a flange engaging rim 58. As will be more fully described below, the flange 56, or as shown in FIG. 2, the flange along with a part of the conical section 52 may be formed with a plurality of slots 60 the number, size and shape of which is used to enable the spring to snap from one state to the next without bending.

Figure 3:
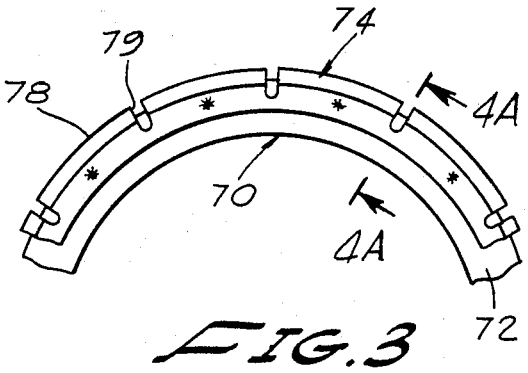
FIG. 3 shows an alternative embodiment of the over-the-center spring of FIG. 2 in which the flange member is a separate piece attached to the spring member.

FIG. 3 shows a modification of the spring means 38 of FIG. 2 which is a spring means 70 including a conical section 72 with a separate flange section 74 attached, for example, by welding, to the conical section. The flange section has a portion 76 which is parallel to the surface of the conical portion 72 and upon which surface the welding is conveniently accomplished, and an angled section 78 forming the flange corresponding to the flange section 56 of the spring means 38 shown in FIG. 2.

Figure 4:
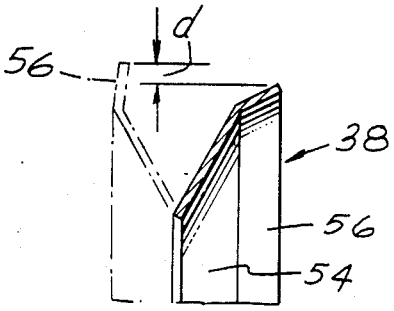
FIG. 4 shows a cross-sectional view of the over-the-center spring of FIG. 2 in both relaxed positions.
Figure 4A:
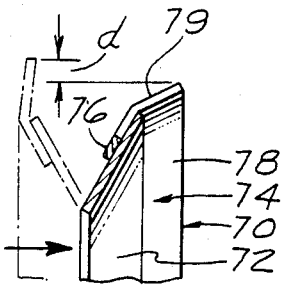

Turing now to FIG. 4 and FIG. 4A, there are shown a cut-away, cross-sectional view of the spring means 38 of FIG. 2 and 70 of FIG. 3, respectively. FIG. 4 shows the spring means 38 in its second position, that is according to the way the spring means is depicted in FIG. 1. The phantom view in FIG. 4 shows the spring means 38 in its first or locking position. It can be seen, that the outer diameter of the circular spring such as shown in FIG. 4 increases by a distance d in the first position of the spring, over the outer diameter of the spring means 38 in its second position. This is chiefly due to the attachment of the flange at an angle to the conical section 54 of the spring means 38 so that the flange 56 assumes a different angle with respect to the axis of rotation of the spring means 38 in the first position than the angle it assumes in the second position. It will be seen by looking at FIG. 4A that the outer diameter of the spring means 70 varies by the same distance between the first and second positions of the springs means 70. The basic difference between the two springs in FIGS. 4 and 4A is simply that the flange portion is separate and affixed to the conical portion in 4A, whereas the flange section 56 is integral with the conical section 54 in the spring means 38 of FIG. 4.

FIG. 5 shows a modification to the spring means 38 according to FIG. 2 in which there are no slots 60, and, also, in which notches 80 positioned opposite each other on the conical section 52 along the engaging rim 54 of the conical section 52 are made available for receiving a tool used in inserting and removing the spring means.

A further modification of the spring means 38 according to FIG. 2 is shown in FIG. 6. There the spring means 90 is shown to have a conical section 92 and a flange section 94. The flange section is shown to have a plurality of slots 96 and the conical section engaging rim 98 has protruding therefrom a plurality of spring tabs 100. The terminal ends of the spring tabs extend the axial dimension of spring means 90 which by the additional leverage obtained significantly changes the force required to pop or flip the conical section 92 of the spring means 90 from the first to the second relaxed positions thereof.

Figure 9:
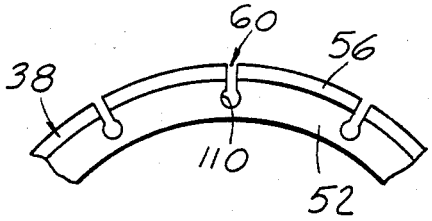
FIG. 9 is a view similar to FIG. 2 of a further alternative embodiment of the spring means of this invention.

A still further version of the spring means 38 is depicted in FIG. 9. As shown, the spring conical section 52 is integral with the flange section 56 as in the FIG. 2 embodiment. The slots 60, however, each bottom in an enlarged opening 110 which reduces the amount of spring material present and thereby the amount of force needed to change the spring from one relaxed position to another.

Turing now to FIGS. 7 and 8 in conjunction with FIG. 1, the operation of the emergency release mechanism, according to the present invention, is illustrated with respect to the particular connector shown in those Figures. The connector is shown in FIG. 1 with the spring means 38 as shown in, e.g., FIG. 2 in the second relaxed position. Force is applied to spring means 38 in the direction of the arrow in FIG. 1 to cause the spring means 38 to assume the first relaxed position, as shown in FIG. 7. For this purpose, the spring means 38 may have the pressure applying notches 80 and a tool having two prongs which engage the notches 80 may conveniently be employed to apply this force. Pressing on the conical portion 52 of the spring means 38 at the opposed points on the rim 54 is a useful way of snapping the spring means 38 into the first or locking relaxed spring position.

In the locking position as shown in FIG. 7, the flange 56 is in a position to be engaged in an annular locking groove 102 in the interior of the coupling ring 32. The outer diameter of the spring means 38 in the first relaxed position, i.e., the locking position, is such that the spring means operates as a locking ring, with the rim 54 pressing against the wave spring cover 36 to compress the wave spring 34 axially of the connector 10. This holds the drive nut 28 in fixed relation to the locking ring 32, and rotation of the coupling ring 32 thereby moves the plug insert sleeve 24 to effect mating of the plug 14 and receptacle 12 portions of the connector 10.

Axial loading of the connector, e.g., by pulling on the wires, exerts a force on the conical portion 52 of the spring means 38 in a direction opposite to the arrow shown in FIG. 1. When a predetermined force is exceeded, the spring means 38 pops or flips to the second relaxed position. As seen in FIG. 8 the flange 56 of the spring means 38 is then in a position to clear the annular groove 102. The drive nut 28 along with the wave spring 34 and its cover 36, then freely slide out of the interior of the locking ring 32, along with the plug insert 24. This disconnects the connector 10.

SUMMARY OF THE INVENTION

It can be seen that the present invention provides a significant improvement over prior art emergency release mechanisims for electrical connectors. The emergency release of the present invention is simple to fabricate and install. In place, it operates as a locking ring until a sufficient force is exerted upon it to pop or flip the emergency release to a position in which its obstructing flange no longer is of an outer diameter sufficient to effectively operate as a locking ring. In this manner, the release mechanism releases without destroying itself and can be reset and reused, and thus is testable to insure release at or above some desired minimum and at or below some desired maximum force. For a given sized connector, e.g., one having a certain available inner diameter of an annular locking groove, various modifications can conveniently be employed to select the force at which release will occur. These include, as explained above, the thickness of the conical portion of the over-the-center spring, the angle of the flange portion to the spring portion, the material from which the spring means is made, and the width of the spring portion from the inner diameter to the bottom of the slots. For a given configuration of the connector, the effective working inner diameter and axial length of the conical portion may be extended with tabs, which substantially modify the force needed to flip the conical section from one releaxed position to the other.

It will be understood by those skilled in the art, that many modifications and changes to the present invention could be made without departing from the scope of the invention. The appended claims are intended to cover such modifications as are with the scope and intent of the claims. It will be further understood, that though the present invention is useful in electrical connectors, it could be used as an emergency release in other related structures as well.

What is claimed is:

1. In an electrical connector having a connector shell and a coupling ring surrounding the shell, an emergency release for securing the shell to the coupling ring, for movement when the coupling ring is rotated, and for releasing the shell from the coupling ring upon the occurence of an axial force on the shell exceeding a preselected amount, comprising:

an annular groove in the interior facing surface of the coupling ring; and an over-the-center spring means with a radially outwardly extending flange portion, said spring means being settable to a first position of a diameter such that the flange portion is received within the annular groove and settable by an axial force exceeding a preselected amount to a second position with the flange portion removed from the annular groove.

2. The connector of the claim 1, wherein the over-the-center spring means is a flat stock conical spring having a apex removed to form an opening centered at the spring apex.

3. The connector of claim 2, wherein the flange is formed of a separate piece attached to the body of the flat stock conical spring surrounding the maximum diameter of the conically shaped body of the spring.

4. The connector of claim 2, wherein the flange is formed with a plurality of radially extending slots in the outer peripheral edge thereof.

5. The connector of claim 4, wherein the body of the spring is formed with a plurality of radial slots extending through a portion of the body and aligned with the slots in the flange.

6. The connector of claim 2, wherein the spring means opening is defined by a rim includes a pair of oppositely disposed pressure-applying notches.

7. The connector of claim 2, wherein the opening is bounded by a rim and the spring is formed with a plurality of tabs extending from the rim toward the imaginary apex of the cone of the spring.

8. An emergency release for an electrical connector having a first member, and a second member contained within the first member and releasably movable with respect to the first member, comprising:

an annular groove in the interior facing surface of the first member;

an annular over-the-center spring having an angularly disposed peripheral flange having a first stable settable position where the flange extends its outer most periphery sufficiently to be engaged in the annular groove, and a second stable settable position of lessened diameter preventing engagement of the flange by the annular groove.

9. The apparatus of claim 8, wherein the over-the-center spring is a flat stock conical spring having the apex removed to form an opening centered at the spring apex.

10. The apparatus of claim 9, wherein the flange is formed with a plurality of radial slots.

11. The apparatus of claim 9, wherein the opening is bounded by a rim and the spring is formed with a plurality of tabs extending from the rim toward the imaginary apex of the cone of the spring.

12. In an electrical connector having a plug shell with a coupling ring rotatably received thereon, releasable means unitarily securing the plug shell and coupling ring together, comprising:

the coupling ring including a circumferential groove on an inner surface;

an annular leaf spring received onto the plug shell with the spring inner edge being affixed to said plug shell and the spring outer edge being received within the coupling ring groove, said spring being settable to an overall smaller diameter upon an axial separating force being applied to the coupling ring and plug shell exceeding a predetermined amount such that the spring outer edge is withdrawn from the groove in the coupling ring releasing the plug shell from the coupling ring.

13. An electrical connector as in claim 12, in which the spring is constructed of flat metal having a major surface formed into frusto-conical shape, said spring being settable to either of two stable frusto-conical shapes with the major surface plane of the spring being angularly oppositely directed in said two shapes.

* * * * *